US010920517B2

(12) United States Patent
Costa de Oliveira et al.

(10) Patent No.: US 10,920,517 B2
(45) Date of Patent: Feb. 16, 2021

(54) VIBRATION-INDUCED INSTALLATION OF WELLBORE CASING

(71) Applicant: Saudi Arabian Oil Company, Dhahran (SA)

(72) Inventors: Victor Carlos Costa de Oliveira, Dhahran (SA); Dean S. Porter, Dhahran (SA); Khaled K. Abouelnaaj, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 91 days.

(21) Appl. No.: 16/450,063

(22) Filed: Jun. 24, 2019

(65) Prior Publication Data

US 2019/0309591 A1 Oct. 10, 2019

Related U.S. Application Data

(63) Continuation of application No. 15/666,711, filed on Aug. 2, 2017, now Pat. No. 10,378,298.

(51) Int. Cl.
*E21B 28/00* (2006.01)
*E21B 7/20* (2006.01)
(Continued)

(52) U.S. Cl.
CPC ..... *E21B 28/00* (2013.01); *E21B 31/005* (2013.01); *E21B 34/063* (2013.01); *E21B 47/00* (2013.01);
(Continued)

(58) Field of Classification Search
CPC ..... E21B 31/005; E21B 28/00; E21B 7/20; E21B 23/08; E21B 4/14; E21B 7/18; E21B 31/113; E21B 7/208
See application file for complete search history.

(56) References Cited

U.S. PATENT DOCUMENTS 1,812,044 A 6/1931 Grant
2,743,083 A 4/1956 Zublin
(Continued)

FOREIGN PATENT DOCUMENTS

CN 204177988 2/2015
EP 377234 10/1989
(Continued)

OTHER PUBLICATIONS

International Search Report and Written Opinion issued in International Application No. PCT/US2018/043663 dated Oct. 19, 2018, 13 pages.
(Continued)

*Primary Examiner* — Kenneth L Thompson
(74) *Attorney, Agent, or Firm* — Fish & Richardson P.C.

(57) ABSTRACT

An unbalanced sub-assembly includes a turbine and a shaft coupled to the turbine at a first end of the shaft. The unbalanced sub-assembly is capable of rotating and imparting a vibration to the casing in response to a fluid being passed through the casing. A rupture disc is positioned on one end of the unbalanced sub assembly. The rupture disc is configured to rupture above a specified differential pressure threshold caused by fluid flowing through the vibration assembly. The rupture disc is capable of allowing the fluid to bypass the unbalanced sub assembly when the rupture disc is in a ruptured state. The rupture disc directs fluid through the unbalanced sub assembly when the rupture disc is in an un-ruptured state.

14 Claims, 3 Drawing Sheets

(51) Int. Cl.

| | |
|---|---|
| ***E21B 31/00*** | (2006.01) |
| ***E21B 47/07*** | (2012.01) |
| ***E21B 34/06*** | (2006.01) |
| ***E21B 47/00*** | (2012.01) |
| ***E21B 47/06*** | (2012.01) |
| ***E21B 47/10*** | (2012.01) |
| ***E21B 47/12*** | (2012.01) |
| *E21B 33/14* | (2006.01) |

(52) U.S. Cl.

CPC ..... *E21B 47/06* (2013.01); *E21B 47/07* (2020.05); *E21B 47/10* (2013.01); *E21B 47/12* (2013.01); *E21B 33/14* (2013.01)

(56) References Cited

U.S. PATENT DOCUMENTS

| | | | |
|---|---|---|---|
| 2,967,048 | A | 1/1961 | Alphones |
| 3,335,801 | A | 8/1967 | Wilsey |
| 3,557,875 | A | 1/1971 | Solum et al. |
| 4,058,163 | A | 11/1977 | Yandell |
| 4,384,625 | A | 5/1983 | Roper et al. |
| 4,399,873 | A | 8/1983 | Lindsey, Jr. |
| 4,458,761 | A | 7/1984 | Van Vreeswyk |
| 4,482,014 | A | 11/1984 | Allwin et al. |
| 4,646,842 | A | 3/1987 | Arnold et al. |
| 4,667,742 | A | 5/1987 | Bodine |
| 4,674,569 | A | 6/1987 | Revils et al. |
| 4,681,159 | A | 7/1987 | Allwin et al. |
| 4,693,328 | A | 9/1987 | Furse et al. |
| 4,852,654 | A | 8/1989 | Buckner |
| 4,855,820 | A | 8/1989 | Barbour |
| 4,890,682 | A | 1/1990 | Worall et al. |
| 4,944,348 | A | 7/1990 | Whiteley et al. |
| 4,993,493 | A | 2/1991 | Arnold |
| 5,152,342 | A | 10/1992 | Rankin et al. |
| 5,390,742 | A | 2/1995 | Dines et al. |
| 5,515,922 | A | 5/1996 | Ruttley |
| 5,582,247 | A | 12/1996 | Brett et al. |
| 5,771,985 | A | 6/1998 | Jaworski |
| 5,947,213 | A | 9/1999 | Angle |
| 6,009,948 | A | 1/2000 | Flanders et al. |
| RE36,556 | E | 2/2000 | Smith |
| 6,142,244 | A | 11/2000 | Hesse |
| 6,152,221 | A | 11/2000 | Carmicheal et al. |
| 6,163,257 | A | 12/2000 | Tracy |
| 6,234,250 | B1 | 5/2001 | Green et al. |
| 6,378,628 | B1 | 4/2002 | McGuire et al. |
| 6,527,066 | B1 | 3/2003 | Rives |
| 6,550,534 | B2 | 4/2003 | Brett |
| 6,577,244 | B1 | 6/2003 | Clark et al. |
| 6,662,110 | B1 | 12/2003 | Bargach et al. |
| 6,684,953 | B2 | 2/2004 | Sonnier |
| 6,691,779 | B1 | 2/2004 | Sezginer et al. |
| 6,739,398 | B1 | 5/2004 | Yokley et al. |
| 6,752,216 | B2 | 6/2004 | Coon |
| 6,873,267 | B1 | 3/2005 | Tubel et al. |
| 6,899,178 | B2 | 5/2005 | Tubel |
| 6,938,698 | B2 | 9/2005 | Coronado |
| 7,219,730 | B2 | 5/2007 | Tilton et al. |
| 7,228,902 | B2 | 6/2007 | Oppelt |
| 7,243,735 | B2 | 7/2007 | Koederitz et al. |
| 7,252,152 | B2 | 8/2007 | LoGiudice et al. |
| 7,278,492 | B2 | 10/2007 | Braddick |
| 7,419,001 | B2 | 9/2008 | Broussard |
| 7,581,440 | B2 | 9/2009 | Meek |
| 7,654,334 | B2 | 2/2010 | Manson |
| 7,665,537 | B2 | 2/2010 | Patel et al. |
| 7,677,303 | B2 | 3/2010 | Coronado |
| 7,938,192 | B2 | 5/2011 | Rytlewski |
| 7,940,302 | B2 | 5/2011 | Mehrotra et al. |
| 8,028,767 | B2 | 10/2011 | Radford et al. |
| 8,102,238 | B2 | 1/2012 | Golander et al. |
| 8,191,635 | B2 | 6/2012 | Buske et al. |
| 8,237,585 | B2 | 8/2012 | Zimmerman |
| 8,334,775 | B2 | 12/2012 | Tapp et al. |
| 8,424,605 | B1 | 4/2013 | Schultz et al. |
| 8,448,724 | B2 | 5/2013 | Buske et al. |
| 8,469,084 | B2 | 6/2013 | Clark et al. |
| 8,528,668 | B2 | 9/2013 | Rasheed |
| 8,540,035 | B2 | 9/2013 | Xu et al. |
| 8,733,469 | B2 | 5/2014 | Konschuh |
| 8,750,513 | B2 | 6/2014 | Renkis |
| 8,789,585 | B2 | 7/2014 | Leising et al. |
| 8,800,655 | B1 | 8/2014 | Bailey |
| 8,833,472 | B2 | 9/2014 | Hay |
| 8,919,431 | B2 | 12/2014 | Lott |
| 8,925,213 | B2 | 1/2015 | Sallwasser |
| 8,991,489 | B2 | 3/2015 | Redlinger et al. |
| 9,051,792 | B2 | 6/2015 | Herberg et al. |
| 9,091,148 | B2 | 7/2015 | Moffitt et al. |
| 9,121,255 | B2 | 9/2015 | Themig et al. |
| 9,140,100 | B2 | 9/2015 | Daccord et al. |
| 9,157,294 | B2 | 10/2015 | Kleppa et al. |
| 9,187,959 | B2 | 11/2015 | Treviranus et al. |
| 9,208,676 | B2 | 12/2015 | Fadell et al. |
| 9,222,312 | B2 | 12/2015 | Anderson |
| 9,341,027 | B2 | 5/2016 | Radford et al. |
| 9,494,003 | B1 | 11/2016 | Can |
| 9,506,318 | B1 | 11/2016 | Brunet |
| 9,546,536 | B2 | 1/2017 | Schultz et al. |
| 9,598,923 | B2 | 3/2017 | Gilleylen |
| 10,378,298 | B2 * | 8/2019 | Costa de Oliveira ..... E21B 31/005 |
| 10,487,604 | B2 * | 11/2019 | Costa de Oliveira .. E21B 47/13 |
| 2002/0148607 | A1 | 10/2002 | Pabst |
| 2003/0001753 | A1 | 1/2003 | Cernocky et al. |
| 2004/0060741 | A1 | 4/2004 | Shipalesky et al. |
| 2004/0156264 | A1 | 8/2004 | Gardner et al. |
| 2005/0273302 | A1 | 12/2005 | Huang et al. |
| 2006/0081375 | A1 | 4/2006 | Ruttley |
| 2006/0086497 | A1 | 4/2006 | Ohmer et al. |
| 2006/0107061 | A1 | 5/2006 | Holovacs |
| 2006/0260799 | A1 | 11/2006 | Broussard |
| 2006/0290528 | A1 | 12/2006 | MacPherson et al. |
| 2007/0057811 | A1 | 3/2007 | Mehta |
| 2007/0107911 | A1 | 5/2007 | Miller et al. |
| 2007/0187112 | A1 | 8/2007 | Eddison et al. |
| 2007/0261855 | A1 | 11/2007 | Brunet |
| 2008/0041631 | A1 | 2/2008 | Vail, III |
| 2008/0115574 | A1 | 5/2008 | Meek |
| 2009/0045974 | A1 | 2/2009 | Patel |
| 2009/0050333 | A1 | 2/2009 | Smith |
| 2009/0114448 | A1 | 5/2009 | Laird et al. |
| 2009/0223670 | A1 | 9/2009 | Snider |
| 2009/0289808 | A1 | 11/2009 | Prammer |
| 2010/0097205 | A1 | 4/2010 | Script |
| 2010/0101786 | A1 | 4/2010 | Lovell et al. |
| 2010/0212891 | A1 | 8/2010 | Stewart et al. |
| 2010/0212900 | A1 | 8/2010 | Eddison et al. |
| 2010/0212901 | A1 | 8/2010 | Buytaert |
| 2010/0258298 | A1 | 10/2010 | Lynde et al. |
| 2010/0282511 | A1 | 11/2010 | Maranuk et al. |
| 2011/0067884 | A1 | 3/2011 | Burleson et al. |
| 2011/0073329 | A1 | 3/2011 | Clemens et al. |
| 2011/0127044 | A1 | 6/2011 | Radford et al. |
| 2011/0147014 | A1 | 6/2011 | Chen et al. |
| 2011/0240302 | A1 | 10/2011 | Coludrovich, III |
| 2011/0266004 | A1 | 11/2011 | Hallundbaek et al. |
| 2012/0048619 | A1 | 3/2012 | Seutter |
| 2012/0085540 | A1 | 4/2012 | Heijnen |
| 2012/0175135 | A1 | 7/2012 | Dyer et al. |
| 2012/0241154 | A1 | 9/2012 | Zhou |
| 2012/0247767 | A1 | 10/2012 | Themig et al. |
| 2012/0307051 | A1 | 12/2012 | Welter |
| 2012/0312560 | A1 | 12/2012 | Bahr et al. |
| 2013/0128697 | A1 | 5/2013 | Contant |
| 2013/0153245 | A1 | 6/2013 | Knobloch et al. |
| 2014/0060844 | A1 | 3/2014 | Barbour et al. |
| 2014/0083769 | A1 | 3/2014 | Moriarty et al. |
| 2014/0090898 | A1 | 4/2014 | Moriarty et al. |
| 2014/0126330 | A1 | 5/2014 | Shampine et al. |
| 2014/0139681 | A1 | 5/2014 | Jones, Jr. et al. |
| 2014/0166367 | A1 | 6/2014 | Campbell et al. |

(56) References Cited

U.S. PATENT DOCUMENTS

| | | | |
|---|---|---|---|
| 2014/0172306 | A1 | 6/2014 | Brannigan |
| 2014/0208847 | A1 | 7/2014 | Baranov |
| 2014/0308203 | A1 | 10/2014 | Sheinberg et al. |
| 2015/0027706 | A1 | 1/2015 | Symms |
| 2015/0090459 | A1 | 4/2015 | Cain et al. |
| 2015/0152713 | A1 | 6/2015 | Garcia et al. |
| 2015/0176362 | A1 | 6/2015 | Prieto et al. |
| 2015/0267500 | A1 | 9/2015 | Van Dongen et al. |
| 2015/0308203 | A1 | 10/2015 | Lewis |
| 2016/0160578 | A1 | 6/2016 | Lee |
| 2016/0215612 | A1 | 7/2016 | Morrow |
| 2016/0230508 | A1 | 8/2016 | Jensen |
| 2016/0237764 | A1 | 8/2016 | Jellison et al. |
| 2016/0237768 | A1 | 8/2016 | Jamison et al. |
| 2016/0356152 | A1 | 12/2016 | Croux |
| 2017/0074071 | A1 | 3/2017 | Tzallas et al. |
| 2017/0292328 | A1 | 10/2017 | Swinford |
| 2018/0030810 | A1 | 2/2018 | Saldanha |
| 2019/0020702 | A1 | 1/2019 | Selekman et al. |
| 2019/0040703 | A1 | 2/2019 | Costa De Oliveira et al. |

FOREIGN PATENT DOCUMENTS

| | | |
|---|---|---|
| EP | 618345 | 10/1994 |
| EP | 2692982 | 5/2014 |
| EP | 2835493 | 2/2015 |
| GB | 2157743 | 10/1985 |
| GB | 2261238 | 12/1993 |
| GB | 2414257 | 11/2005 |
| GB | 2460096 | 11/2009 |
| GB | 2470762 | 12/2010 |
| WO | 2003058545 | 7/2003 |
| WO | 2011038170 | 3/2011 |
| WO | 2011095600 | 8/2011 |
| WO | 2011159890 | 12/2011 |

OTHER PUBLICATIONS

International Search Report and Written Opinion issued in International Application No. PCT/US2018/043665 dated Oct. 19, 2018, 13 pages.

Engineering Innovation Worldwide, TIW XPAK Liner Hanger System brochure, 2015 TIW Corporation, Houston TX , TIW0001D Jun. 2015, retrieved form the internet at: http://www.tiwoiltools.com/Images/Interior/downloads/tiw_xpak_brochure.podf, 4 pages.

Engineers Edge—ACME Stub Threads Size Designation Table Chart, retrieved from the internet at: http://www.engineersedge.com/hardware/acme-stub-thread.htm, retrieved Feb. 27, 2017, 2 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

Offshore, "Completions Technology: Large monobore completions prevent high-volume gas well flow restrictions", Dec. 1, 2001, retrieved from the internet: • http://www.offshore-mag.com/articles/print/volume-61/issue-12/news/completions-technology-large-monobore-completions-prevent-high-volume-gas-well-flow-restrictions.html, 9 pages.

* cited by examiner

VIBRATION-INDUCED INSTALLATION OF WELLBORE CASING

CROSS REFERENCE TO RELATED APPLICAITONS

This application is a Continuation of U.S. patent application Ser. No. 15/666,711, filed on Aug. 2, 2017, the entire contents of which is incorporated herein by reference.

TECHNICAL FIELD

This disclosure relates to wellbore drilling and completions and, for example, to optimizing casing installation within the wellbore.

BACKGROUND

When completing a production or injection wellbore, casing can sometimes be installed to line the walls of the wellbore. Casing can include steel piping with an outer diameter that is less than the diameter of the wellbore. The casing can help provide structural support to the wellbore and seal the wellbore from parts of the geologic formation in which the wellbore has been formed.

Installing casing involves running long strings of pipe, also known as casing strings, through at least a portion of a wellbore, from a topside facility. While the casing string is being run, fluid can be circulated through the casing string and up through the annulus formed between the outer surface of the casing string and the inner wall of the wellbore. The circulating fluid helps provide static pressure on the geologic formation to prevent a "kick" from the wellbore, or releasing pressurized hydrocarbons to the environment.

Once the casing has reached a target depth within the wellbore, cement can be circulated similarly to the previously circulated fluid. The cement hardens in the annulus and secures the casing in place. The cement can also act as an added layer of protection between the wellbore and the geologic formation.

SUMMARY

This disclosure describes technologies relating to vibration-induced installation of wellbore casing.

An example implementation of the subject matter described within this disclosure is a wellbore casing string vibration assembly with the following features. An unbalanced sub-assembly includes a turbine and a shaft coupled to the turbine at a first end of the shaft. The unbalanced sub-assembly is capable of rotating and imparting a vibration to the casing in response to a fluid being passed through the casing. A rupture disc is positioned on one end of the unbalanced sub assembly. The rupture disc is configured to rupture above a specified differential pressure threshold caused by fluid flowing through the vibration assembly. The rupture disc is capable of allowing the fluid to bypass the unbalanced sub assembly when the rupture disc is in a ruptured state. The rupture disc directs fluid through the unbalanced sub assembly when the rupture disc is in an un-ruptured state.

Aspects of the example implementation, which can be combined with the example implementation alone, or in combination, include the following. The shaft is an unbalanced shaft that has an uneven weight distribution along a longitudinal axis of the shaft. The turbine and the unbalanced shaft are capable of rotating in response to the fluid being passed through the casing. The rotating, unbalanced shaft imparts the vibration to the casing.

Aspects of the example implementation, which can be combined with the example implementation alone or in combination, include the following. The unbalanced shaft further includes a rotary bar coupled to and rotatable with the turbine. The rotary bar includes a first axial portion of a first outer diameter and a second axial portion of a second outer diameter attached end-to-end with the first axial portion. The first outer diameter is different from the second outer diameter. A rotation of the rotary bar with the turbine imparts a vibration to the casing.

Aspects of the example implementation, which can be combined with the example implementation, alone or in combination, include the following. The turbine is a first turbine. The vibration assembly further includes a second turbine positioned at a second end of the unbalanced shaft than the first turbine.

Aspects of the example implementation, which can be combined with the example implementation, alone or in combination, include the following. The turbine, the unbalanced shaft, and the rupture disc are configured to be drilled out after use.

Aspects of the example implementation, which can be combined with the example implementation, alone or in combination, include the following. The turbine is configured to reduce a rotational speed when the rupture disc is in the ruptured state.

Aspects of the example implementation, which can be combined with the example implementation, alone or in combination, include the following. The fluid passing through the turbine comprises drilling fluid or cement.

Aspects of the example implementation, which can be combined with the example implementation, alone or in combination, include the following. A rotational speed sensor is positioned in an outer housing of the vibration assembly. The rotational speed sensor is capable of detecting a rotational speed of the turbine. A first hydrostatic pressure sensor is positioned in the outer housing of the vibration assembly. The first hydrostatic pressure sensor is configured to measure a static pressure within the casing. A second hydrostatic pressure sensor is positioned in the outer housing of the vibration assembly. The second hydrostatic pressure sensor is capable of measuring a static pressure of an annulus between an outer surface of the casing and an inner surface of the wellbore. A controller is positioned in the outer housing of the vibration assembly. The controller is capable of receiving, processing, and transmitting data received from the rotational speed sensor, the first hydrostatic pressure sensor, and the second hydrostatic pressure sensor. A battery is positioned in the outer housing of the vibration assembly. The battery is capable of imparting electrical energy to the controller, rotational speed sensor, the first hydrostatic pressure sensor, and the second hydrostatic pressure sensor.

Aspects of the example implementation, which can be combined with the example implementation, alone or in combination, include the following. A generator is coupled to the turbine. The generator is capable of charging the battery.

Aspects of the example implementation, which can be combined with the example implementation, alone or in combination, include the following. A temperature sensor is capable of measuring a temperature of the annulus between an outer surface of the casing and an inner surface of the wellbore.

Aspects of the example implementation, which can be combined with the example implementation, alone or in combination, include the following. The controller is capable of determining a casing leak based on a signal from the first hydrostatic pressure sensor and a signal from the second hydrostatic pressure sensor.

Aspects of the example implementation, which can be combined with the example implementation, alone or in combination, include the following. The controller is capable of diagnosing a failure in the rotational speed sensor, the first hydrostatic pressure sensor, or the second hydrostatic pressure sensor.

Aspects of the example implementation, which can be combined with the example implementation, alone or in combination, include the following. The controller is configured to wirelessly transmit a status of the vibration assembly to a topside facility.

Aspects of the example implementation, which can be combined with the example implementation, alone or in combination, include the following. The rotational speed sensor, the first hydrostatic pressure sensor, the second hydrostatic pressure sensor, the controller, and the battery are all configured to remain within the outer housing of the vibration assembly after the casing string is installed.

An example of the subject matter described within this disclosure is a method with the following features. An annulus is defined between the casing string and a wellbore. While running a casing string to a target depth within the wellbore, a coefficient of friction between the casing string and the wellbore is reduced by inducing a vibration within the casing string by activating a vibration inducing device positioned within the casing string. A closed fluid bypass channel is positioned within the vibration inducing device. A fluid is flowed through the casing string. The fluid passes through the vibration inducing device while the closed fluid bypass channel is closed to the flow of the fluid through the fluid bypass channel. In response to an increase in a differential pressure of the fluid resulting from an increased flow of the fluid within the casing, the fluid bypass channel is opened. At least a portion of the fluid flows through the opened fluid bypass channel, and a remainder of the fluid flows through the vibration inducing device causing a change in the vibration induced within the casing string. The fluid is flowed through the annulus while the casing string vibrates at the changed vibration induced within the casing string.

Aspects of the example method, which can be combined with the example method, alone or in combination, include the following. After setting the casing string at the target depth and after flowing the fluid through the annulus, the vibration inducing device is drilled through prior to starting production through the casing string.

Aspects of the example method, which can be combined with the example method, alone or in combination, include the following. A status of the vibration inducing device is wirelessly sent to a topside facility. The status includes a rotational speed of the vibration inducing device, a static pressure within the casing, and a static pressure within the annulus.

Aspects of the example method, which can be combined with the example method, alone or in combination, include the following. Wirelessly sending the status includes transmitting radio waves to the topside facility.

Aspects of the example method, which can be combined with the example method, alone or in combination, include the following. Opening a bypass includes rupturing a rupture disc. The rupture disc is configured to rupture when a differential pressure across the vibration inducing device goes above a specified threshold.

Aspects of the example method, which can be combined with the example method, alone or in combination, include the following. The vibration inducing device includes a turbine. Inducing a vibration includes inducing rotation in an unbalanced shaft that defines the bypass channel. The unbalanced shaft is coupled to the turbine. The bypass channel is capable of diverting at least a portion of the flow away from the turbine.

An example of the subject matter described within this disclosure is a second method with the following features. An annulus is defined between a casing string and a wellbore. While running the casing string to a target depth within the wellbore, a coefficient of friction between the casing string and the wellbore is reduced by inducing a vibration within the casing string, by activating a vibration inducing device positioned within the casing string. The vibration inducing device includes a turbine positioned within the casing string. The turbine is configured to rotate in response to a fluid flow passing through the casing joint during installation operations. An unbalanced shaft defines a bypass flow path. The unbalanced shaft is coupled to the turbine. The unbalanced shaft is configured to impart a vibration to the casing as the turbine rotates. A rupture disc is positioned on one end of the unbalanced shaft. The rupture disc is configured to rupture above a specifies pressure differential threshold caused by the fluid flow across the turbine. The rupture disc is configured to allow at least a part of the fluid flow through the bypass flow path when the rupture disc is in a ruptured state. The rupture disc is configured to direct the fluid flow through the turbine when the rupture disc is in an un-ruptured state. The turbine is configured to rotate at a lower rotational speed when the disc is in the ruptured state. A fluid is flowed through the casing string to induce a vibration. The fluid passes through the vibration inducing device when the bypass flow path closed to flow of the fluid flows through the bypass flow path. In response to an increase in a differential pressure of the fluid resulting from an increased flow of the fluid within the casing, the bypass flow path is opened. At least a portion of the fluid flows through the opened fluid bypass flow path, and a remainder of the fluid flows through the vibration inducing device causing a change in the vibration induced within the casing string.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

When installing a casing string into a wellbore, especially long, horizontal, or deviated wellbores, friction between the casing string and the walls of the wellbore can make installation difficult or impossible. In some instances, wellbore tractors can be deployed to pull the casing through the wellbore, but tractors cannot always be used in certain situations. For example, String weight, hole tortuosity, debris buildup in the open-hole, clay-swelling, or hole collapse can prevent the use of a tractor. If a tractor cannot be used, the wellbore can sometimes be re-drilled or reamed, but both options present high cost and extend the time needed to complete the wellbore. In some cases, neither re-drilling nor re-reaming can be done.

In addition, once the casing has reached its target depth, cementing the casing and ensuring an even distribution of cement can be a challenge. If a cement job is not satisfactorily completed, that is, the cement is not evenly distributed, cured, or bonded, then the entire cased section can need to be plugged and re-drilled. Such operation can cause extreme delays in completing the wellbore.

This disclosure relates to a smart vibration assembly that can be added to a casing string during installation for the purposes of reducing the apparent friction between the casing and the wellbore, and aid in compacting and distributing cement during cementing operations. The vibration assembly is powered by fluid, such as cement, drilling mud, or other fluids, flowing through a turbine and rotating an unbalanced component to produce vibrations. The vibration components are constructed from drillable materials so that the vibration components can be "drilled out" and removed after installation is complete. The assembly also contains sensors and communication equipment that can monitor pressure within the assembly, pressure within the annulus, RPMs of the turbine, internal flow, and any other pertinent parameters. The communication equipment is able to relay information back to a topside facility wirelessly. The assembly also includes a bypass that can be activated by bursting a rupture disc. The bypass can allow for low-frequency vibrations at high flow rates.

Figure 1:
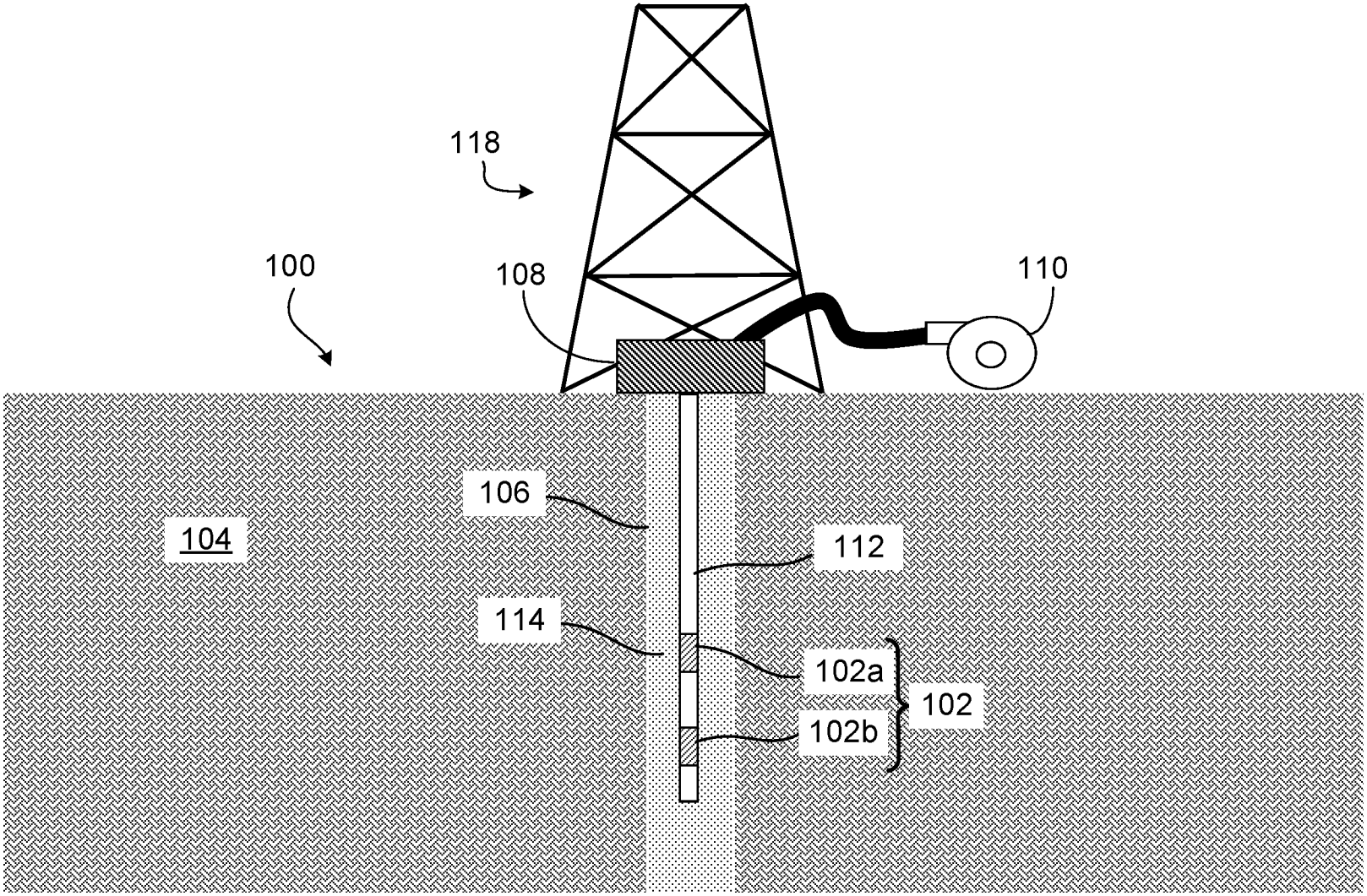
FIG. 1 is a schematic diagram of an example casing installation system.

FIG. 1 shows a wellbore system 100 that can be used to complete a wellbore 106 formed within geologic formation 104. The wellbore system 100 can include a derrick 118 that supports a casing string 112 to be installed within a wellbore 106. During completion operations, wellbore fluid is pumped down the wellbore with a pump 110, through the casing string 112, and up the annulus 114 of the wellbore 106. The wellbore fluid can include drilling mud, cement, or any other circulation fluid. The annulus 114 of the wellbore 106 is the space between an outer surface of the casing string 112 and the wall of the wellbore 106. In some implementations, the static pressure from the circulation fluid can prevent the pressurized release of hydrocarbons from the wellbore 106.

The casing string 112 can include a vibration assembly 102. The vibration assembly is powered by the fluid flowing through the casing string 112. In some implementations, multiple vibration assemblies can be used, such as the first vibration assembly 102*a* and the second vibration assembly 102*b*. While the illustrated implementation shows two vibration assemblies, as many vibration assemblies as needed can be used. While the illustrated implementation shows the casing string 112 being installed in a vertical wellbore, the system can also be utilized in a deviated or horizontal wellbore. Aspects of this disclosure can be applied to either production or injection wellbores.

Figure 2:
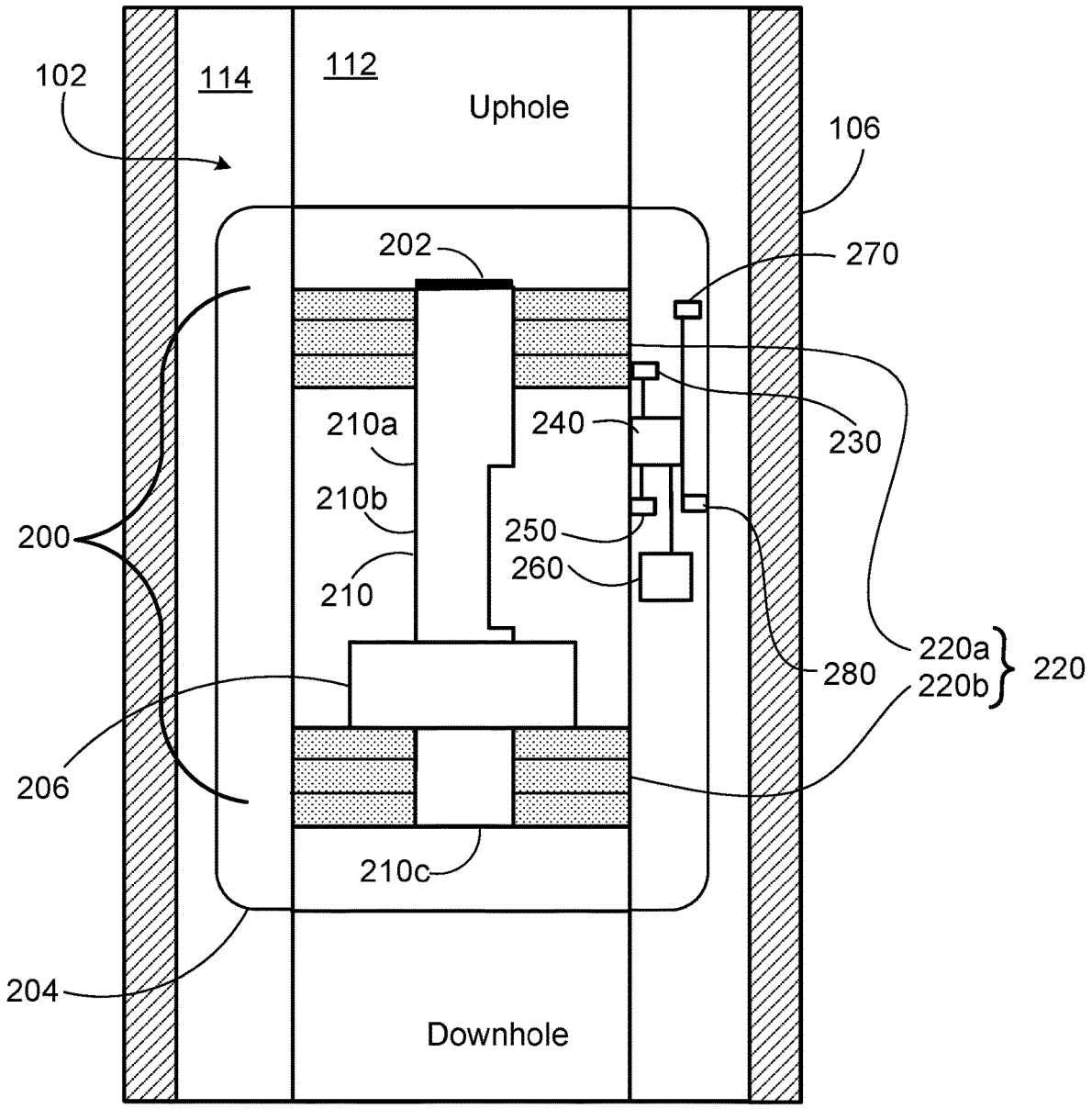
FIG. 2 is a schematic diagram of a side cross-sectional view of an example vibration inducing mechanism.

FIG. 2 shows a detailed cross-section of an example vibration assembly 102. The vibration assembly includes an unbalanced sub-assembly 200 that includes a turbine 220 and a shaft 210 coupled to the turbine 220 at a first end of the shaft 210. While the illustrated implementation shows the turbine 220*a* being attached to an uphole end of the shaft 210 and turbine 220*b* attached to the downhole end of the shaft, a single turbine 220 can be used. The unbalanced sub-assembly 200 is capable of rotating to impart a vibration to the casing string 112 in response to a fluid being passed through the casing and through the turbine 220*a*, turbine 220*b*, or both. The fluid passing through the turbines 220 can include drilling fluid, cement, or any other fluid circulated through the casing string. While the illustrated implementations show turbines being used to convert energy from the fluid flow into rotational motion, other mechanisms can be used to produce a similar effect. For example, a mud motor could be used in lieu of a turbine.

The shaft 210 is hollow and defines a fluid flow pathway along its longitudinal axis. In some implementations, the shaft 210 is an unbalanced shaft that has an uneven weight distribution along the longitudinal axis of the shaft 210. For example, the shaft 210 can include end portions of a first diameter and a center portion between the end portions of a second diameter different from (that is, less than or more than) the first diameter. Starting from a shaft having a substantially constant diameter along its longitudinal axis, some material can be removed from the center portion to reduce that portion's diameter relative to the remainder of the shaft. Alternatively, the shaft can be formed into an unbalanced shaft by removing portions from one or both end portions or the center portion and one of the end portions. In some implementations, the length of the shaft can be divided into two portions and material can be removed from one of the two portions to form the unbalanced shaft.

The turbine and the unbalanced shaft rotate in response to the fluid being passed through the casing. The uneven weight distribution along the longitudinal axis induces a vibration in the shaft as the shaft rotates. In this manner, the rotating, unbalanced shaft imparts the vibration to the casing. In some implementations, the unbalanced shaft includes a rotary bar coupled to, and rotatable with, the turbine 220. The rotary bar includes a first axial portion 210*a* of a first outer diameter and a second axial portion 210*b* of a second outer diameter, attached end-to-end with the first axial portion. The first outer diameter is different from the second outer diameter. This offset causes the rotation of the rotary bar with the turbine 220 to impart a vibration to the casing. In some implementations, a third axial portion 210*c* can be included with the rotary bar. The third portion 210*c* can be axially aligned with the first axial portion 210*a*. In some implementations, a weight can be added to the rotary bar to provide at least a portion of the imbalance. While the illustrated implementation shows an unbalanced shaft 210 as the source of vibration, some implementations can include an imbalanced turbine to produce a similar affect.

In the illustrated implementation, a rupture disc 202 is positioned on one end of the unbalanced sub assembly 200, for example, on an uphole end of the unbalanced shaft 210 to seal that end of the shaft 210. The rupture disc is designed to rupture (that is, burst or break to an extent that fluid can flow through the ruptured disc) above a specified differential pressure threshold caused by fluid flowing through the vibration assembly. The rupture disc 202 can include a ceramic material, a metal alloy, or any other drillable material. The rupture disc 202 is designed to rupture instantly when the specified differential pressure threshold is reached. The rupture disc 202 is either in the ruptured state, or in an un-ruptured state. There is no practical transition period between states.

When the rupture disc is in an un-ruptured state, the rupture disc directs fluid through the unbalanced sub assembly 200 and blocks the flow of fluid through the shaft 210. Specifically, for the illustrated example, the rupture disc directs the entirety of the fluid flow through at least one of the turbines 220*a* or 220*b* and does not flow any portion of the fluid through the shaft 210. Even if the rupture disc 202 does not completely block the shaft 210, in the un-ruptured state, a quantity of fluid that flows through the shaft 210 is significantly less (for example, less than 20% in volume) compared to a quantity of fluid that bypasses the shaft 210 and flows through at least one of the turbines 220*a* or 220*b*.

When the rupture disc 202 is in a ruptured state, that is, the rupture disc 202 has burst, the burst rupture disc 202 allows a portion of the fluid to bypass the unbalanced sub assembly 200. Specifically, for the illustrated example, the rupture disc allows at least a portion of the flow to bypass the turbine 220*a* and turbine 220*b* by allowing fluid to flow through the shaft 210. For example, a quantity of fluid that flows through the shaft 210 after the rupture disc 202 has ruptured is significantly higher than any quantity that flows through the shaft 210 before the rupture disc 202 has ruptured. In other words, although the entirety of the fluid continues to flow through the unbalanced sub assembly 200, only a portion of the fluid flows over the turbines 220*a* and 220*b*.

Once the rupture disc is in a ruptured state and a portion of the fluid flow is directed away from either the first turbine 220*a*, the second turbine 220*b* or both, the reduced flow over the turbines 220 causes the turbines 220 to reduce a rotational speed. The reduction in rotational speed reduces a vibrational frequency of the induced vibration. While the illustrated implementation shows a bypass passing through the shaft 210, some implementations can use a different flow path, for example, a bypass can be located in an outer housing 204 of the vibration assembly. While the illustrated implementation shows the bypass bypassing both the first turbine 220*a* and 22*b*, some implementations can bypass only a single turbine to produce a similar reduction in vibration frequency.

The one or more turbines 220, the shaft 210, and the rupture disc 202 are configured to be drilled out after use. That is, once the casing string 112 is cemented in place, a drill bit is passed through the casing to pulverize the one or more turbines 220, the shaft 210, and the rupture disc 202. To accomplish, this, the aforementioned components can be made of a soft, drillable material, such as an aluminum alloy, a bronze alloy, a brass alloy, a plastic, a composite, or any other drillable material.

The illustrated implementation includes several electronic and electromechanical components as well. A rotational speed sensor 230 is positioned in an outer housing 204 of the vibration assembly 102. The rotational speed sensor is capable of detecting a rotational speed of the turbine 220. If multiple turbines 220 are used, multiple speed sensors 230 can be used. In some implementations, the RPM of the turbine can be used to calculate a flow rate passing through the apparatus 102. In some implementations, a flow rate can be determined by a first apparatus 102*a* and a second apparatus 102*b*. The difference between the two flow rates can be used to determine the presence of a casing leak.

A first hydrostatic pressure sensor 250 is positioned in the outer housing 204 of the vibration assembly 102. The first hydrostatic pressure sensor 250 is capable of measuring a static and/or dynamic pressure within the casing string 112. A second hydrostatic pressure sensor 270 is positioned in the outer housing 204 of the vibration assembly 102. The second hydrostatic pressure sensor 270 is capable of measuring a static and/or dynamic pressure of the annulus 114 between an outer surface of the casing string 112 and an inner surface of the wellbore 106. While only the first pressure sensor 250 and the second pressure sensor 270 are shown in the illustrated implementations, more pressure sensors can be used. For example, a pressure sensor can be used to measure a pressure uphole of the turbine 220*a* as well as downhole of the turbine 220*b* in order to measure a pressure drop across the vibration assembly 102. In some implementations, a second RPM sensor can be included to measure the RPMs of the second turbine 220*b*. Comparing the RPMs of the first turbine 220*a* and the second turbine 220*b* can aid in diagnosing turbine blade failures. In some implementations, the vibration assembly 102 can include a temperature sensor 280 capable of measuring a temperature of the annulus 114 between an outer surface of the casing string 112 and an inner surface of the wellbore 106.

The vibration assembly 102 also includes a controller 240 that is positioned in the outer housing 204 of the vibration assembly 102. The controller is capable of receiving, processing, and transmitting data received from the rotational speed sensor 230, the first hydrostatic pressure sensor 250, the second hydrostatic pressure sensor 270, the temperature sensor 280, and any other sensors that are included in the vibration assembly 102. The controller 240 is capable of determining the presence of a casing leak based on a signal from the first hydrostatic pressure sensor 250 and a signal from the second hydrostatic pressure sensor 270. The controller is capable of diagnosing a failure in the rotational speed sensor 230, the first hydrostatic pressure sensor 250, the second hydrostatic pressure sensor 270, or any other sensor included with the vibration assembly 102. The controller can use a telemetry sequence to receive information from the sensors and can determine failures based on the sequence. For example, the controller can send a predetermined current of voltage to the sensor and measure the sensor response. In some implementations, the controller can send data to a topside facility to be evaluated by a topside controller or a field engineer. The controller is capable of wirelessly transmitting a status of the vibration assembly to a topside facility. For example, the status can include a rotational speed of the vibration inducing device 102, a static pressure within the casing string 112, a static pressure within the annulus 114, or any other status applicable to the operation of the vibration inducing device. In general, all information from the sensors can be transmitted to the topside facility. To accomplish this, the controller can include one or more wireless transmitters and receivers to communicate with the topside facility 108. The one or more wireless transmitters and receivers can transmit and receive information through radio waves, mud pulses, acoustics, Wi-Fi, Bluetooth, or any other wireless transmission technology. In some implementations, the vibration assembly 102 can receive an "on" signal or an "off" signal from a topside facility and respond to the "on" or "off" signal using the same wireless transmission technology.

A battery 260 is positioned in the outer housing 204 of the vibration assembly 102. The battery 260 is capable of imparting electrical energy to the controller 240, rotational speed sensor 230, the first hydrostatic pressure sensor 250, the second hydrostatic pressure sensor 270, and any other electronic component included within the vibration assembly 102. The battery can include a lithium-ion battery, a lead acid battery, a nickel-cadmium battery, or any other type of battery. The battery 260 can be housed within a separate, reinforced chamber to prevent corrosion of the vibration assembly in the event of a battery failure. In some implementations, a generator 206 can be coupled to the turbine 220. In such an instance, the generator 206 can be used to charge the battery.

In the illustrated implementation, the rotational speed sensor 230, the first hydrostatic pressure sensor 250, the second hydrostatic pressure sensor 270, the controller 240, and the battery 260 are all configured to remain within the outer housing 204 of the vibration assembly after the casing string is installed. That is, because these components are located within the housing 204 and out of the flow path, the electronics are not drilled out with the mechanical components. The outer housing is left permanently installed with the casing after cementing operations are completed. The electronics are packaged in such a way to not degrade the casing string after it is permanently installed. For example, the sensors, the battery 260, the controller 240, and any other electronic components are sealed within the housing 204 of the vibration apparatus 102 with no flow-path to either the annulus 114 or the casing string 112.

Figure 3:
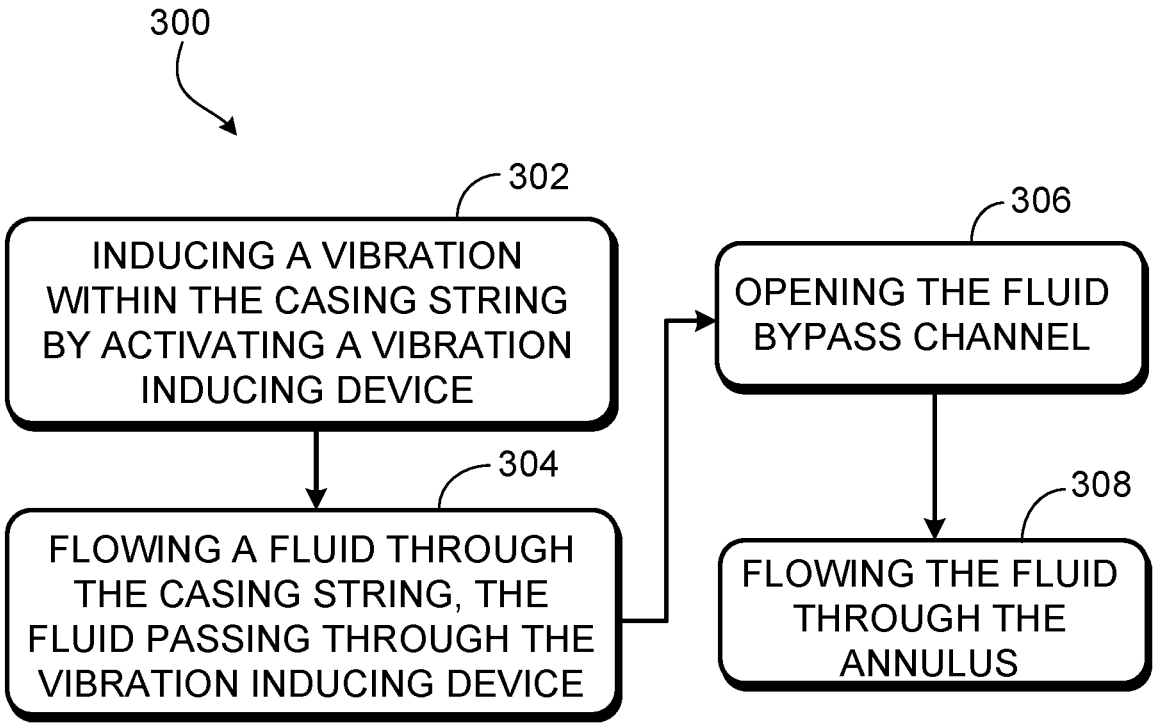
FIG. 3 is a flowchart of an example method that can be used to install casing into a wellbore.

FIG. 3 is a flowchart of an example method 300 that can be utilized with certain aspects of this disclosure. At 302, while running a casing string 112 to a target depth within a wellbore 106, a coefficient of friction is reduced between the casing string and the wellbore by inducing a vibration within the casing string 112 by activating a vibration inducing device positioned within the casing string. A closed fluid bypass channel is positioned within the vibration inducing device 102. The vibration inducing device includes a turbine 220. Inducing a vibration can include inducing rotation in an unbalanced shaft 210 that defines the bypass channel and is coupled to the turbine. The bypass channel is capable of diverting at least a portion of the flow away from the turbine 220 when opened.

At 304, a fluid is flowed through the casing string 112. The fluid passes through the vibration inducing device 102. The closed fluid bypass channel is closed to the flow of the fluid through the fluid bypass channel. When in the closed state, the fluid flows entirely through the vibration inducing device 102.

At 306, in response to an increase in a differential pressure of the fluid across the vibration inducing device 102 resulting from an increased flow of the fluid within the casing string 112, the fluid bypass channel is opened. Opening a bypass can include rupturing a rupture disc 202. The rupture disc 202 is configured to rupture when a differential pressure across the vibration induction device goes above a specified threshold. At least a portion of the fluid flows through the opened fluid bypass channel and a remainder of the fluid flows through the vibration inducing device causing a change in the vibration induced within the casing string. At 308, the fluid is flowed through the annulus 114 while the casing string 112 vibrates at the changed vibration induced within the casing string 112. In some implementations, the rupture disc 202 need not be ruptured. That is, the rupture disc 202 is only activated when a need arises. For example, cementing operations can sometimes be performed without needing to open the bypass.

During the installation process, a status of the vibration inducing device 102 is sent wirelessly to a topside facility. In some implementations, the wireless transmission can be transmitted using radio waves. In some implementations, mud pulses, acoustics, Wi-Fi, Bluetooth, or any other wireless transmission technology can be used.

The vibration inducing device 102 is drilled through after setting the casing string at the target depth and after flowing the fluid through the annulus 114, such as cement, and prior to starting production or injection through the casing string 112.

Thus, particular implementations of the subject matter have been described. Other implementations are within the scope of the following claims.

The invention claimed is:

1. A method of installing a casing string into a wellbore, the method comprising:

while running a casing string to a target depth within a wellbore, an annulus defined between the casing string and the wellbore, reducing a coefficient of friction between the casing string and the wellbore by inducing a vibration within the casing string by activating a vibration inducing device positioned within the casing string, a closed fluid bypass channel positioned within the vibration inducing device;

flowing a fluid through the casing string, the fluid passing through the vibration inducing device, the closed fluid bypass channel closed to flow of the fluid through the fluid bypass channel;

in response to an increase in a differential pressure of the fluid resulting from an increased flow of the fluid within the casing, opening the fluid bypass channel, wherein at least a portion of the fluid flows through the opened fluid bypass channel and a remainder of the fluid flows through the vibration inducing device causing a change in the vibration induced within the casing string; and flowing the fluid through the annulus while the casing string vibrates at the changed vibration induced within the casing string.

2. The method of claim 1, further comprising, after setting the casing string at the target depth and after flowing the fluid through the annulus, drilling through the vibration inducing device prior to starting production through the casing string.

3. The method of claim 1, further comprising sending a status of the vibration inducing device wirelessly to a topside facility, wherein the status comprises a rotational speed of the vibration inducing device, a static pressure within the casing, and a static pressure within the annulus.

4. The method of claim 3, wherein wirelessly sending the status comprises transmitting radio waves to the topside facility.

5. The method of claim 1, wherein the fluid flowing through the casing string comprises drilling fluid or cement.

6. The method of claim 1, wherein opening a bypass comprises rupturing a rupture disc, wherein the rupture disc is configured to rupture when a differential pressure across the vibration inducing device goes above a specified threshold.

7. The method of claim 6, wherein the vibration inducing device includes a turbine, and wherein inducing a vibration comprises inducing rotation in an unbalanced shaft that defines the bypass channel, the unbalanced shaft being coupled to the turbine, the bypass channel configured to divert at least a portion of the flow away from the turbine.

8. The method of claim 7, wherein the turbine is a first turbine, the method further comprising positioning a second turbine at a second end of the unbalanced shaft than the first turbine.

9. The method of claim 7, wherein the turbine is configured to reduce a rotational speed when the rupture disc is in a ruptured state.

10. The method of claim 7, further comprising:

detecting a rotational speed of the turbine with a rotational speed sensor positioned within the casing string;

measuring a status pressure within the casing with a first hydrostatic pressure sensor positioned within the casing string;

measuring a static pressure of the annulus between an outer surface of the casing and an inner surface of the wellbore with a second hydrostatic pressure sensor positioned within the casing string; and causing a controller positioned within the casing string to receive, process, and transmit data received from the rotational speed sensor, the first hydrostatic pressure sensor, and the second hydrostatic pressure sensor.

11. The method of claim 10, further comprising measuring a temperature of the annulus with a temperature sensor.

12. The method of claim 10, wherein the controller is configured to determine a casing leak based on a signal from the first hydrostatic pressure sensor and a signal from the second hydrostatic pressure sensor.

13. The method of claim 10, wherein the controller is configured to diagnose a failure in the rotational speed sensor, the first hydrostatic pressure sensor, or the second hydrostatic pressure sensor.

14. The method of claim 10, wherein the rotational speed sensor, the first hydrostatic pressure sensor, the second hydrostatic pressure sensor, and the controller are all configured to remain within the casing string after the casing string is installed.

* * * * *